United States Patent [19]

Fischer

[11] 4,058,873

[45] Nov. 22, 1977

[54] CURTAIN AND DRAPE HOLDER

[75] Inventor: Edward T. Fischer, McKee Rocks, Pa.

[73] Assignee: The Raymond Lee Organization, Inc., New York, N.Y.

[21] Appl. No.: 708,496

[22] Filed: July 26, 1976

[51] Int. Cl.[2] ..... A44B 21/00

[52] U.S. Cl. ..... 24/73 CH; 160/349 R

[58] Field of Search ..... 160/349 R, 349 D; 248/291, 293; 292/241; 24/73 CH

[56] References Cited

U.S. PATENT DOCUMENTS

| | | | |
|---|---|---|---|
| 607,683 | 7/1898 | Downer | 248/293 |
| 609,965 | 8/1898 | Kelsey | 160/349 D |
| 1,666,408 | 4/1928 | Dalton | 160/349 D |
| 1,789,644 | 1/1931 | Cisler | 292/241 |
| 2,405,354 | 8/1946 | Hansen et al. | 160/349 |

*Primary Examiner*—Werner H. Schroeder
*Assistant Examiner*—Doris L. Troutman
*Attorney, Agent, or Firm*—Howard I. Podell

[57] ABSTRACT

An assembly attachable to a side of a window opening for gathering to a side, curtains or drapes hung over the window opening. The assembly consists of a flat plate fitted with attachment holes to which an arm member is pivotably mounted. One or more detents are mounted to the plate to each serve as a stop so that in the mounted position, the arm member may rotated from a first vertical position alongside the window opening frame to a second, generally horizontal position, in which the arm member projects away from the window opening frame to serve as holder for curtains or drapes that are to be held, in gathered fashion, away from the window opening.

2 Claims, 2 Drawing Figures

CURTAIN AND DRAPE HOLDER

SUMMARY OF THE INVENTION

My invention is an assembly attachable to a side of a window opening for gathering to a side, curtains or drapes hung over the window opening. The assembly consists of a flat plate fitted with attachment holes to which an arm member is pivotably mounted. One or more detents are mounted to the plate to each serve as a stop so that in the mounted position, the arm member may be rotated from a first vertical position alongside the window opening frame to a second, generally horizontal position, in which the arm member projects away from the window opening frame to serve as holder for curtains or drapes that are to be held, in gathered fashion, away from the window opening.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
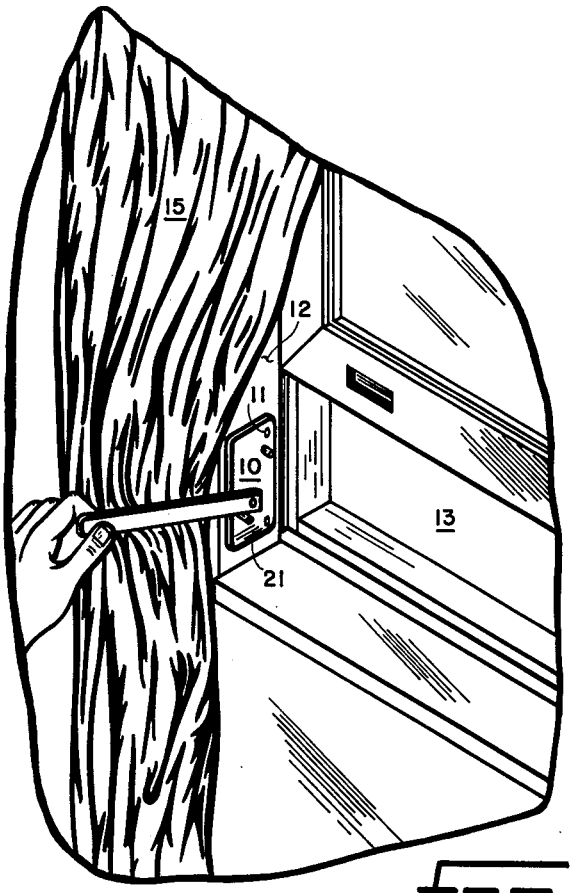
FIG. 1 is a perspective view of the invention in use.
Figure 2:
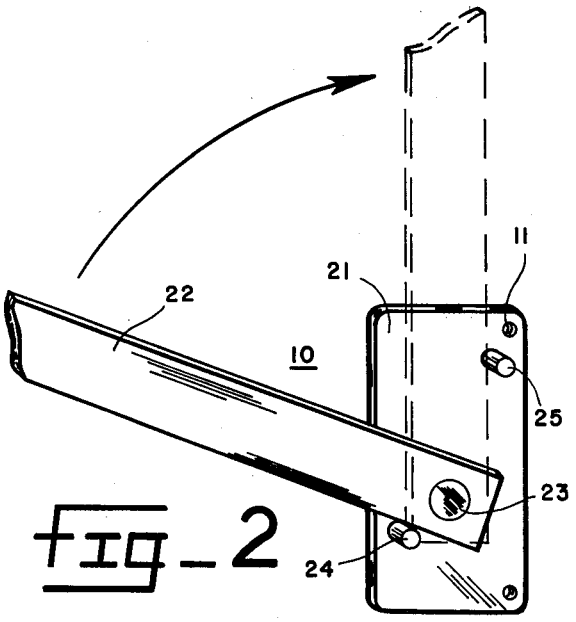
FIG. 2 is an elevation view of the invention.

Turning now descriptively to the drawings, in which similar reference characters denote similar elements throughout the several views, FIGS. 1–2 illustrate the device 10 fastened by screws 11 to a side panel 12 bordering a window opening 13 over which drapes 15 may be hung.

The device 10 is formed of a base plate 21 to which arm member 22 is pivotably mounted by fixed flush rivet 23, with arm member 22 being in the form of a strip of generally rectangular cross-section. A pin 24 is fixed to base plate 21 to project externally of plate 21 and located to serve as a stop to restrain rotation in a given direction of the strip 22 with relation to plate 21 and a second pin 25 may be similarly fastened to plate 21 at a second location to limit the rotational travel of strip 22 in the opposite direction.

In use, plate 21 is fixed to a vertical side panel 12 of a window opening by screws 11 through holes in base plate 21, in a position to permit arm member 22 to travel from an extended generally horizontal position shown in FIG. 1, in which position curtains 15 may be gathered away from the window opening 13, to a vertical position shown in dash lines in FIG. 2, in which the arm member 22 extends in a vertical plane parallel to window side panel 12 and concealed from view by curtains 15 which are then draped over window opening 13.

Since obvious changes may be made in the specific embodiment of the invention described herein, such modifications being within the spirit and scope of the invention claimed, it is indicated that all matter contained herein is intended as illustrative and not as limiting in scope.

Having thus described the invention what I claim as new and desire to secure by Letters Patent of the United States is:

1. An assembly adaptable for mounting to a side panel of a window opening for the purpose of gathering a hung curtain, comprising a flat base plate pivotably mounted by a rivet to an arm member of generally rectangular cross-section, with said plate fitted with rotational stop means to limit the travel of the arm member in each of two directions, with said rotational stop means comprising two spaced pins fixed to the plate that project from the external face of the plate, said pins located with respect to the rivet so that in the installed position of the plate against a window opening side panel, the arm member may be rotated to a first position in which a first straight edge of the arm member rests on a first pin, with the axis of the arm member extending along a generally horizontal axis or alternately the arm member may be rotated to a second position in which a second straight edge of the arm member rests against the second pin with the axis of the arm member extending along a generally vertical axis, said base plate formed with a plurality of holes for use in fastening the plate to a window opening panel.

2. The combination as recited in claim 1 attached to the side panel of a window opening.

* * * * *